US009074817B2

(12) United States Patent
Jegatheeswaram Pillai et al.

(10) Patent No.: US 9,074,817 B2
(45) Date of Patent: Jul. 7, 2015

(54) FLUIDISED BED TREATMENT

(71) Applicant: ROLLS-ROYCE PLC, London (GB)

(72) Inventors: Bhrami Jegatheeswaram Pillai, Derby (GB); Paul Anthony Goulding, Derby (GB); Daniel Jason Howe, Hereford (GB); Kin Keung Chan, Dudley (GB)

(73) Assignee: ROLLS-ROYCE PLC, London (GB)

( * ) Notice: Subject to any disclaimer, the term of this patent is extended or adjusted under 35 U.S.C. 154(b) by 255 days.

(21) Appl. No.: 13/683,197

(22) Filed: Nov. 21, 2012

(65) Prior Publication Data

US 2013/0149655 A1 Jun. 13, 2013

(30) Foreign Application Priority Data

Dec. 13, 2011 (GB) ..... 1121356.8

(51) Int. Cl.

| | |
|---|---|
| ***F27B 15/00*** | (2006.01) |
| ***F27B 15/02*** | (2006.01) |
| ***C21D 1/74*** | (2006.01) |
| ***C21D 9/00*** | (2006.01) |

(Continued)

(52) U.S. Cl.

CPC . *F27B 15/02* (2013.01); *C21D 1/74* (2013.01); *C21D 9/0062* (2013.01); *C21D 1/53* (2013.01); *F27B 15/18* (2013.01); *F27D 99/0073* (2013.01); *C21D 2221/00* (2013.01)

(58) Field of Classification Search

CPC ..... F27B 15/10; F27B 15/00; F27B 15/02; F27B 15/14; C21D 1/53; C21D 9/567

USPC ..... 432/27, 58, 15

See application file for complete search history.

(56) References Cited

U.S. PATENT DOCUMENTS 3,519,497 A 7/1970 Pomey
3,718,024 A * 2/1973 Vitelli ..... 72/201

(Continued)

FOREIGN PATENT DOCUMENTS

DE 3429707 C1 9/1985
EP 0 342 918 A2 11/1989

(Continued)

OTHER PUBLICATIONS

Jul. 16, 2012 Search Report issued in British Patent Application No. GB1121356.8.

(Continued)

*Primary Examiner* — Steven B McAllister
*Assistant Examiner* — Ko-Wei Lin
(74) *Attorney, Agent, or Firm* — Oliff PLC

(57) ABSTRACT

An apparatus for the treatment of a component using a fluidized bed of powder fluidized by a gas flow has a treatment chamber for receiving at least a treatment part of the component and for containing the fluidized bed. A fluidizing gas inlet provides fluidizing gas to the treatment chamber and a fluidizing gas outlet removes used fluidizing gas from the treatment chamber. A powder screen is located between the treatment chamber and the fluidizing gas outlet, the powder screen operable substantially to prevent loss of powder from the fluidizing bed entrained in the fluidizing gas removed from the treatment chamber. The treatment chamber can be small and moveable, and then applied to a part of a component to be treated. Heating of the fluidized bed may be provided by heating of the fluidizing gas in a fluidizing gas reservoir remote from the treatment chamber.

9 Claims, 3 Drawing Sheets

(51) Int. Cl.

| | |
|---|---|
| ***C21D 1/53*** | (2006.01) |
| ***F27B 15/18*** | (2006.01) |
| ***F27D 99/00*** | (2010.01) |

(56) References Cited

U.S. PATENT DOCUMENTS

| | | | | | |
|---|---|---|---|---|---|
| 4,966,101 | A | * | 10/1990 | Maeda et al. | 122/4 D |
| 5,159,897 | A | * | 11/1992 | Franke et al. | 122/367.3 |
| 2008/0118407 | A1 | | 5/2008 | Grace et al. | |

FOREIGN PATENT DOCUMENTS

| | | | |
|---|---|---|---|
| EP | 1 354 967 | A1 | 10/2003 |
| FR | 2 423 258 | A1 | 11/1979 |
| GB | 906349 | | 9/1962 |
| GB | 2 179 267 | A | 3/1987 |
| JP | A-63-282486 | | 11/1988 |
| JP | A-64-46576 | | 2/1989 |
| JP | A-1-180919 | | 7/1989 |
| JP | A-1-184221 | | 7/1989 |
| JP | A-2-272209 | | 11/1990 |
| JP | A-2-282416 | | 11/1990 |
| JP | A-4-41615 | | 2/1992 |
| JP | A-10-46576 | | 2/1998 |
| JP | A-10-184221 | | 7/1998 |
| JP | A-2003-13142 | | 1/2003 |
| JP | A-2005-59054 | | 3/2005 |

OTHER PUBLICATIONS

European Search Report issued in European Patent Application No. 12 19 3537 on Mar. 11, 2013.

* cited by examiner

FLUIDISED BED TREATMENT

FIELD OF THE INVENTION

The present invention relates to methods of treatment of components using fluidised beds, and to apparatus for carrying out such methods. The invention has particular, but not exclusive, application to the thermal treatment of components, such as metallic components. Suitable thermal treatments typically include heat treatment but may also include cooling treatment. Suitable thermal treatments may be applied to a component in order to promote stress relief and/or the development of a preferred microstructure, for example, in order to obtain desired mechanical properties. The invention has particular applicability to the treatment of turbomachinery blades, but the invention is not necessarily limited to the treatment of such components.

BACKGROUND OF THE INVENTION

A fluidised bed typically consists of a bed of solid particles in the form of a powder (referred to as "media" or "solid media") situated on a distributor plate located above a plenum chamber. The distributor plate has an arrangement of many gas flow passages through it. Introduction of air into the plenum chamber creates a pressure drop across the distributor plate. The resultant flow of process gas into the bed of media causes fluidisation. The result is a heterogeneous mixture of process gas and solid particles that behaves macroscopically as a fluid.

Fluidised beds typically provide a very high surface area contact between the fluidising gas and the solid media, compared with the contact area available for a packed solid bed. Fluidised beds also provide very good thermal transfer between the walls of the fluidised bed apparatus, the fluidising gas, the media and any component located in the media. This is due to the high surface area contact between the fluidising gas and the solid media and due to the very frequent particle-particle, particle-wall and particle-component collisions.

Fluidised bed apparatus typically have rectangular or cylindrical configurations.

It is known to use fluidised beds in order to provide a controlled heat treatment for components, for example in order to provide a hardness gradient within the component. Some example disclosures are discussed below.

U.S. Pat. No. 3,519,497 discloses a method of controlling the cooling of a rail section. The rail section is subjected to hot rolling and is immediately submerged in a fluidised bed. The fluidised bed is maintained at a predetermined temperature, in order to provide isothermal conditions for a bainitic microstructural transformation. The rail section is held in the fluidised bed in a particular orientation in order to provide stagnant regions of the flow in the fluidised bed. In turn, this affects the rate of cooling to which different parts of the rail section are subjected, and so affects the hardness/metallurgical properties throughout the rail section.

DE-C-3429707 discloses a method of locally hardening drill bits. A cartridge is loaded with drill bits. The cartridge is submerged into a fluidised bed. The cartridge holds the drill bits in such a way that, for each drill bit, only the surface to be treated is exposed whilst the remainder is shielded with insulation. This allows a custom boundary/interface to be achieved for varying component geometries.

In the two documents discussed above, the entire component is submerged in the fluidised bed, but special measures are taken in order to achieve differential heat treatment of different parts of the component.

Other documents disclose the submersion of only a part of the component to be treated, in order to ensure that only the submerged part is subjected to the required heat treatment. The intention here is also to provide a localised heat treatment in order to produce a controlled and sustained thermal gradient within and across the component.

For example, JP-A-2005-059054 discloses the use of a fluidised bed to create a high temperature gradient within a component. The component is partially dipped in at the top of the bed for localised heat treatment to induce a temperature gradient. FIGS. 2, 3 and 4 of JP-A-2005-059054 show how the component is suspended above the top of the bed and the part of the component to be treated is lowered into the bed.

JP-A-2003-013142 discloses heat treatment of a pipe section. The pipe section has a major portion formed with a constant, relatively small, wall thickness. A connection portion at the end of the pipe section, however, has a greater wall thickness. In order to apply the same heat treatment to the different parts of the pipe section, when taking into account the different wall thickness, the connection portion of the pipe is dipped into a fluidised bed, in order to provide a heat treatment specific to that part of the pipe section. The entire pipe section is held in a furnace in order to provide a heat treatment specific to the major portion of the pipe section.

SUMMARY OF THE INVENTION

The present inventors have realised that there are drawbacks with the methods and apparatus discussed above, when the aim is to provide local heat treatment of only part of a component.

Partially submerging a component in the fluidised media can lead to poor repeatability of the heat treatment process. This is because the surface of the fluidised media is not perfectly level but instead the local height of the surface fluctuates randomly, due to bubbling. Thus there is the problem that it can be very difficult to obtain an even exposure level of the chosen part of the component for heat treatment.

The restrictions of gravity mean that the surface of the fluidised media (ignoring the local random fluctuations mentioned above) is horizontal. This affects the parts, shape and orientation of the component that can be treated. Typically, if it is wanted to subject more than one part of the component to the same heat treatment at the same time, these parts of the component must be located on the component in such a disposition as to allow simultaneous submersion of these parts in the fluidised media.

With respect to U.S. Pat. No. 3,519,497, this document discloses submerging the entire component into the fluidised bed and yet still obtaining different rates of cooling at different parts of the component. However, the disclosure of U.S. Pat. No. 3,519,497 is still effectively a 'global' heat transfer process, and it would be difficult to modify that disclosure in order to achieve a highly localised application of heat treatment to a component.

With respect to DE-C-3429707, it is considered likely that the insulated parts of the components submerged into the fluidised media would still be subjected to unwanted heat treatment over prolonged time. Still further, it is considered that it would be difficult to apply the teaching of DE-C-3429707 to large components, because this would involve manufacturing a large container that could encapsulate and protect sections of the component that should be protected from the heat treatment.

The present inventors have realised that it would be advantageous to be able to carry out treatment on components that may be relatively difficult to treat by immersion in a known fluidised bed. Such components may be large, attached to other components, am and/or it may be wanted to carry out the treatment on only a treatment part of the component. In such a case, the present inventors realise that it may be more convenient to present the fluidised bed to the component, rather than to present the component to the fluidised bed.

The present inventors have therefore devised fluidised bed treatments that allow is treatment of a treatment part of a component by inserting only the treatment part of the component into the fluidised bed, whilst ensuring that a non-treatment part of the component is outside the fluidised bed. Such treatments are of interest to be used with different flow rates of fluidised gas. However, the use of different flow rates of fluidised gas leads to a potential problem of loss of media from the fluidised bed.

The present invention has been devised in order to address at least one (and preferably all) of the problems mentioned above. In preferred embodiments, the present invention reduces, ameliorates, avoids or even overcomes one or more of these problems.

In a first preferred aspect, the present invention provides an apparatus for the treatment of a component using a fluidised bed of powder fluidised by a gas flow, the apparatus including:

a treatment chamber for receiving at least a treatment part of the component and for containing the fluidised bed;

a fluidising gas inlet for providing fluidising gas to the treatment chamber;

a fluidising gas outlet for removing used fluidising gas from the treatment chamber;

a powder screen located between the treatment chamber and the fluidising gas outlet, the powder screen operable substantially to prevent loss of powder from the fluidising bed entrained in the fluidising gas removed from the treatment chamber.

In a second preferred aspect, the present invention provides a process for the treatment of a component using a fluidised bed of powder fluidised by a gas flow, wherein the fluidised bed is formed in a treatment chamber and in contact with at least a treatment part of the component, the fluidised bed formed using a fluidising gas flowing into the treatment chamber from an inlet, fluidising gas being removed from the treatment chamber via a fluidising gas outlet, wherein a powder screen is located between the treatment chamber and the fluidising gas outlet, the powder screen operating substantially to prevent loss of powder from the fluidising bed entrained in the fluidising gas removed from the treatment chamber.

The first and/or second aspect of the invention may have any one or, to the extent that they are compatible, any combination of the following optional features.

The pressure of fluidising gas at the fluidising gas inlet may be controlled in a known manner by pressure regulation in order to provide the desired degree of fluidisation of the powder bed contained in the treatment chamber.

The fluidising gas inlet may be supplied with fluidising gas via a fluidising gas inlet conduit. The fluidising gas inlet conduit may be connected to a source of pressurised fluidising gas. Preferably, the treatment chamber is moveable with respect to the source of pressurised fluidising gas. In order to accommodate this, preferably, the fluidising gas inlet conduit is flexible. This helps to position the treatment chamber with respect to the component to be treated, without necessarily needing to reposition the source of pressurised fluidising gas. Similarly, the fluidising gas inlet conduit may be extendable, e.g. telescopic.

A distribution unit may be located between the fluidising gas inlet and the treatment chamber. The distribution unit is provided in order to distribute the incoming fluidising gas in order to generate the required fluidised bed. Preferably, before fluidisation, the bed of powder may be supported by the distribution unit. Typically, the distribution unit is provided in the form of a distribution plate. The distribution unit typically has gas flow passages formed through it. Preferably, the gas flow passages are small enough substantially to prevent passage of the powder particles through the distribution unit and into the fluidising gas inlet. The distribution unit may be in the form of a mesh, for example.

The powder screen may have a similar structure to that of the distribution unit, in particular in terms of having gas flow passages formed through it that are small enough substantially to prevent passage of the powder particles through the powder screen and into the fluidising gas outlet. The aperture of the gas flow passages in the powder screen are preferably larger than the aperture of the gas flow passages in the distribution unit, bearing in mind the function of the powder screen being to prevent the powder from escaping. Preferably, the footprint area of the powder screen is greater than the footprint area of the distribution unit. This assists in the prevention of powder accumulation towards the fluidising gas outlet.

The fluidising gas outlet may be open to the atmosphere. In this case, the fluidising gas is typically air. However, for some treatments of some components, it may be preferred that the fluidising gas is not air. For example, an inert gas may be preferred, e.g. nitrogen or argon. In some embodiments, it is preferred to recycle the fluidising gas. This allows heat recovery from the fluidising gas, and also reduces the cost of operating the apparatus. Thus, it is preferred that the fluidising gas outlet is in communication with a fluidising gas outlet conduit. This in turn may be in communication with a fluidising gas reservoir.

The fluidising gas in the reservoir may be subjected to a heat exchange process in order to recover thermal energy from the fluidising gas.

The fluidising gas in the reservoir may be subject to pressurisation, in order for it to be re-used as fluidising gas to be directed to the fluidising gas inlet of the treatment chamber.

Preferably, the treatment chamber is moveable with respect to the fluidising gas reservoir. In order to accommodate this, preferably, the fluidising gas outlet conduit is flexible. This helps to position the treatment chamber with respect to the component to be treated, without necessarily needing to reposition the fluidising gas reservoir. Similarly, the fluidising gas outlet conduit may be extendable, e.g. telescopic.

Preferably, the fluidising gas inlet conduit is of a length suitable to the required distance between the source of pressurised fluidised gas and the treatment chamber and the component to be treated. For example, the fluidising gas inlet conduit may be at least 1 m long. Similar considerations apply to the fluidising gas outlet conduit.

The treatment chamber may include more than one fluidising gas inlet. Multiple inlets may be preferred in particular in order to establish a desired powder flow distribution within the treatment chamber. For example, it may be required to have different parts of the component subjected to powder flow at different angles. This can help to ensure that the required heat treatment is given to the treatment part of the component in the treatment chamber. Similarly, the treatment chamber may include more that one fluidising gas outlet.

Fluidisation of the bed can be assisted. For example, vibration can be used to assist the gas flow in fluidisation of the bed.

The apparatus may include more than one treatment chamber. Each treatment chamber may be used to treat a different treatment part of the same or different components. This allows the same source of pressurised fluidising gas to be used to treat the different treatment parts simultaneously, giving rise to efficient operation of the apparatus. Similarly, the same fluidising gas reservoir can be used for each treatment chamber.

Where the treatment to be applied to the component is a thermal treatment, preferably the fluidised bed is heated or cooled. This is preferably not achieved by incorporation of heating or cooling means within the fluidised bed, because to do so places limits on the configuration of the fluidised bed. Instead, suitable heating/cooling means may be provided in contact with the treatment chamber. Additionally or alternatively, the fluidising gas may be heated or cooled as appropriate, by fluidising gas heating/cooling means. Preferably, the fluidising gas heating/cooling means are located remote from the treatment chamber and the treatment chamber is movable with respect to said fluidising gas heating/cooling means. For example, the fluidising gas heating/cooling means may be located at the fluidising gas reservoir and/or source of pressurised fluidising gas.

Defined with respect to the direction of gravity on the apparatus during operation, the fluidising gas outlet may be at the top of the treatment chamber. However, it is also possible in some embodiments for the fluidising gas outlet to be at a side of the treatment chamber. Further explanation of these features is set out below.

The present inventors have considered the situation in which part of a component is submerged under the surface of a fluidised bed, leaving the remainder of the component projecting from the surface of the fluidised bed. The inventors have realised that the boundary between the part of the component to be treated and the remainder of the component is constrained by the global horizontal arrangement of the surface of the fluidised bed and the locally random irregularly fluctuating shape of the surface of the fluidised bed. Instead of this, the inventors propose that the boundary between the part of the component to be treated and the reminder of the component should be defined by a boundary containment surface of the fluidised bed. Such a surface can be located with precision, and need not be horizontal, nor planar. This allows the repeatability of the treatment to be improved, and also improves the flexibility of the process, in terms of treating different parts of different components.

Considering that the fluidised bed is retained in the treatment chamber by one or more containment surfaces, at least one treatment part of the component is typically placed in the fluidised bed and at least one non-treatment part of the component is located substantially outside the chamber and out of contact with the fluidised bed. In this case, the boundary between the treatment part and the non-treatment part of the component is preferably defined by a boundary containment surface at a fixed location with respect to the component.

The use of a boundary containment surface in order to define the part of the component to be treated avoids the problem discussed above in relation to the locally random irregularly fluctuating shape of the surface of the fluidised bed. Furthermore, allowing the non-treatment part of the component to extend out of the treatment chamber means that large components can be treated according to the invention, without the need for a correspondingly large treatment chamber, fluidised bed and shield (for shielding the non-treatment part of the component inside the large treatment chamber).

Preferably, the apparatus is adjustable in order to adjust the position of the component with respect to the fluidised bed. For example, the depth of submersion of the treatment part may be adjustable, by suitable adjustment of the location of the component and the boundary containment surface.

Preferably, the treatment chamber has at least one side wall, in order to restrain lateral flow of the fluidised bed, the side wall thereby forming part of the boundary containment surface. Preferably, the component is disposed with respect to the treatment chamber so that the treatment part of the component is located within the treatment chamber on one side of the side wall and so that the non-treatment part of the component is located on the other side of the side wall, outside the treatment chamber. In this way, the side wall provides a definite and fixed limit to the contact between the treatment portion and the fluidised bed.

Preferably, the side wall is adapted to the shape of the component. Thus, the side wall preferably has one or more apertures corresponding in shape and location to the treatment parts of the component.

Forming multiple apertures in the side wall as discussed above allows a corresponding number of components, or multiple parts of one component, to be treated by the fluidised bed at the same time, if required.

In some embodiments, the side wall may be non-planar in order to accommodate a required non-planar boundary between the treatment parts and non-treatment parts of the component. For example, the side wall may be curved. More complex shapes, to correspond with more complex components, are of course easily envisaged and produced.

In some embodiments, the aperture for location of the component in the treatment chamber may extend through the powder screen.

Preferably, the boundary containment surface includes at least one seal member to seal between the component and the treatment chamber (e.g. the side wall of the treatment chamber). The seal member is typically locatable in an aperture in the side wall, as mentioned above. The seal member may be shaped to complement the component shape, in order to adapt the component shape to an aperture in the side wall of the treatment chamber. In this way, one treatment chamber may be used in order to treat a series of different components of different (but typically generally similar) shapes, by providing a corresponding series of seal members. Typically, the seal member is compressible to accommodate the component. For example, a hollow seal member may be used, a hollow cavity within the seal capable of being deformed in order to fit between the side wall of the treatment chamber and the component.

Additionally or alternatively, the side wall of the treatment chamber may be replaceable, e.g. in order to adapt the treatment chamber to a more radical difference in shape between components to be treated.

Thus, in the kit of parts, the interchangeable boundary containment surfaces may be provided by a series of seal means of different shape as mentioned above and/or by a series of side walls of different shape.

In some preferred embodiments, the component may have two or more treatment parts. It is preferred, where possible, that these treatment parts are treated in the fluidised bed simultaneously. Thus, preferably the apparatus includes a corresponding plurality of boundary containment surfaces in order to define the boundary between each treatment part and the non-treatment part(s).

Where the component has two or more treatment parts, the apparatus and/or method may be adapted to allow different treatment of the treatment parts using the fluidised bed. For example, the fluidising gas flow at a first region corresponding to a first treatment part may be different to the fluidising gas flow at a second region corresponding to a second treatment part. This can be achieved by blanking off a respective part of the distributor plate of the apparatus, and/or a variation in the treatment chamber dimensions, and/or a diversionary gas stream bifurcation to regulate pressure. Additionally or alternatively, the first treatment part may have shield means applied (e.g. insulation, or deliberate stagnation to vary temperature/heat transfer coefficient as a means of insulation) different to the second treatment part.

The overall shape of the treatment chamber may, for example, be based on a rectangular shape, a parallelogram shape, a cylindrical shape, an annular shape or a partial annular shape (e.g. half-annular shape). The overall shape of the treatment chamber does not necessarily need to follow the shape of the component, but in some embodiments this is preferred.

The preferred embodiments of the invention have particular utility in the heat treatment of parts of components, e.g. in order to control the mechanical properties of the components. Suitable heat treatments include controlling the temperature of the treatment part so that the treatment part has a higher or lower temperature than the non-treatment part. Additionally or alternatively, suitable heat treatments include controlling the temperature of the treatment part so that the treatment part has a higher or lower rate of change of temperature than the non-treatment part.

However, the present invention is not necessarily limited to such heat treatments. The concept of the present invention may be applied to other uses of fluidised beds, such as the use of such beds to carry out chemical reactions. Thus, any suitable application of fluidised beds can benefit from introducing a component at the side of the bed. The present invention preferably allows local, more uniform media flow around a component that is not easily achievable by other methods.

The solid particles may have any suitable size/shape/density distribution in order to carry out the required treatment in an efficient manner. For example, the population of solid particles may have a multi-modal size/shape/density distribution.

As mentioned above, the fluidising gas may be independently heated.

Temperature in the process can be monitored directly, e.g. using one or more thermocouples in the bed. Additionally or alternatively, temperature may be monitored indirectly, measurement of flow of fluidising gas, power input, exit gas temperatures, etc.

Preferably, in use, less than 50% by volume of the component is contained in the treatment part(s) of the component. Thus, preferably, the majority of the component is not located in the fluidised bed.

Active cooling of the non-heat treated regions of the component can be incorporated to encourage the desired temperature gradient across the target areas.

In the process, it is preferred that the component is initially installed in the treatment chamber before the solid particle bed is fluidised. In this case, the treatment part(s) of the component are preferably located above the surface of the solid particle bed before fluidisation. On fluidisation, the treatment part(s) of the component are then preferably completely submerged under the rising surface of the fluidised bed. This is advantageous because it allows the component to be installed in the treatment chamber without risking loss of the media.

More generally, in the process, it is possible for the component to be brought to the treatment chamber for treatment, as implied above. However, for larger components, it may be preferred for the treatment chamber to be portable, in order to treat the component in situ. Additionally or alternatively, the treatment chamber may be assembled around the treatment part of the component. In this case, typically, the media for the fluidised bed is added after assembly of the treatment chamber around the treatment part of the component. In some embodiments, it may be preferred for the apparatus to be provided in a clam-shell-like arrangement, in order to embrace and seal with the component in order to treat the treatment part.

Further optional features of the invention are set out below.

BRIEF DESCRIPTION OF THE DRAWINGS

Embodiments of the invention will now be described by way of example with reference to the accompanying drawings in which.

DETAILED DESCRIPTION OF THE PREFERRED EMBODIMENTS, AND FURTHER OPTIONAL FEATURES OF THE INVENTION

The basic design of a fluidised bed involves a bed of solid media (which in some embodiments is alumina powder, but any suitable powder can be used) situated on a distributor plate (a suitable porous or mesh-like material) located above a plenum chamber. Introduction of process gas (or other fluidising gas) into the plenum chamber creates a pressure drop across the distributor plate, which in turn fluidises the media above. The holes in the distributor plate, through which the process gas flows, are typically small enough to prevent passage of the solid particles in the reverse direction through the distributor plate. Usually, fluidised beds are either rectangular or cylindrical in shape, the shape being defined by the shape of the plenum chamber and the corresponding distributor plate and also by the configuration of the side wall which contains the fluidised bed from flowing laterally out of the apparatus.

Figure 1:
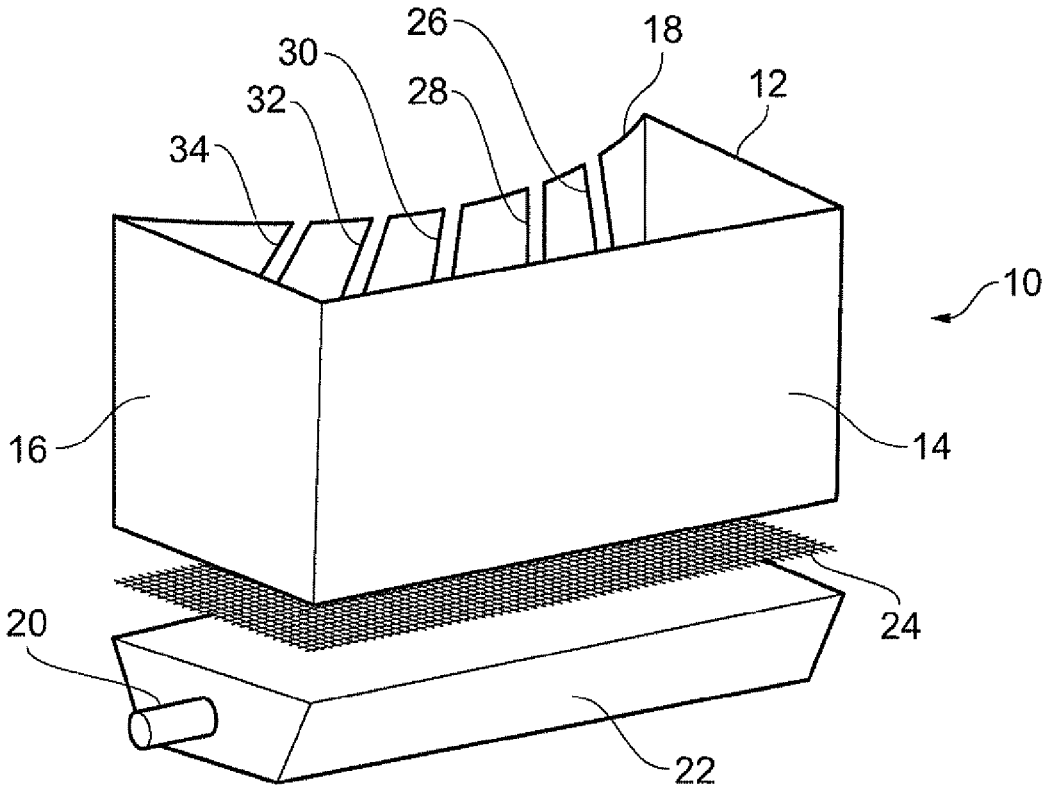
FIG. 1 shows a schematic view of a treatment chamber for use with an embodiment of the invention.

FIG. 1 shows a schematic view of a fluidised bed apparatus for use in an embodiment of the invention. The apparatus is based on a rectangular bed configuration. The apparatus has a treatment chamber 10 with four side walls. Three of the side walls 12, 14, 16 are vertical in orientation and planar in shape. The remaining side wall 18 is not planar in shape, and is described in further detail below.

The apparatus has a fluidising gas inlet 20 which delivers fluidising gas at an appropriate (and adjustable) pressure to plenum chamber 22. Interposed between plenum chamber 22 and treatment chamber 10 is distributor plate 24. Distributor plate 24 is arranged generally horizontally and is formed of a mesh sized to prevent the particulate (not shown) used as the fluidised bed media from passing from the treatment chamber into the plenum chamber.

Side wall 18 of the treatment chamber attaches to side wall 12 and side wall 16. In some preferred embodiments, side wall 18 may be removably attachable to side wall 12 and side wall 16. In that case, a different side wall, typically of different shape, may be substituted for side wall 18, in order to use the apparatus to treat a different component.

Side wall 18 includes an arrangement of apertures 26, 28, 30, 32, 34. In this embodiment, each aperture takes the form of an elongate slot. In this embodiment, each aperture is open at the top of side wall 18, but in other embodiments, one or more of the apertures may not be open at the top of side wall 18. Apertures 26-34 allow treatment parts of a component (or of multiple components) to be inserted into the treatment chamber, whilst a non-treatment part of the component remains outside the treatment chamber.

The general curved shape of side wall 18 is illustrated in FIG. 1. This allows the shape of the non-treatment part of the component to be accommodated outside the treatment chamber, whilst ensuring that the treatment parts of the component are located inside the treatment chamber.

In the example illustrated in FIG. 1, the treatment chamber is adapted to treat blades, for example fan blades, compressor blades and/or gas turbine blades of a gas turbine engine.

Each aperture 26-34 is shaped in order to locate and fit with the component to be treated. Forming each aperture as an elongate slot allows the position (e.g. height) of the treatment parts of the component to be varied in the treatment chamber.

In order to reduce the likelihood of the media from the fluidised bed escaping from the treatment chamber via any gap between the component (not shown in FIG. 1) and apertures 26-34, it is preferred to provide a seal (not shown in FIG. 1) between the component and each aperture. The seal therefore provides a boundary containment surface in order to contain the fluidised bed with respect to the component and the side wall of the treatment chamber.

FIGS. 2-5 illustrate various sealing arrangements for providing the boundary containment surface between the component and the side wall of the treatment chamber.

Figure 2:
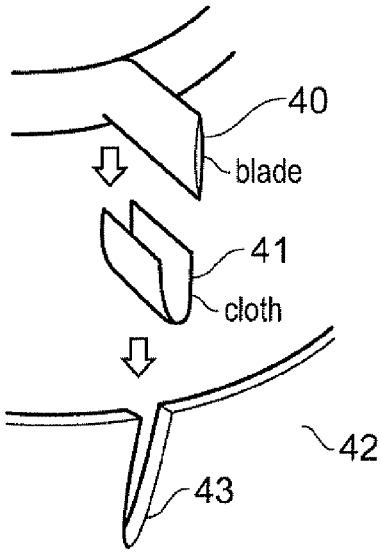
FIG. 2 shows a schematic view of the process of applying a sealing member around a turbine blade and inserting the wrapped turbine blade into an aperture in the side wall of a treatment chamber.

In FIG. 2, a turbomachinery blade 40 is wrapped in a ceramic cloth 41 and the wrapped blade is inserted into aperture 43 in side wall 42 of a treatment chamber. Suitable ceramic cloths are known which can withstand temperatures of around 850° C. Aperture 43 can have a tapered shape, so that as the wrapped component 40 is pressed downwardly, the cloth 41 is compressed between the side wall and the component, giving sealing between the component and the side wall.

Figure 3:
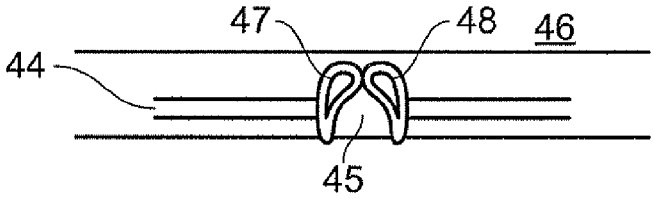
FIG. 3 shows a schematic sectional view of a side wall of a treatment chamber with sealing members sealing across an aperture in the side wall.
Figure 4:
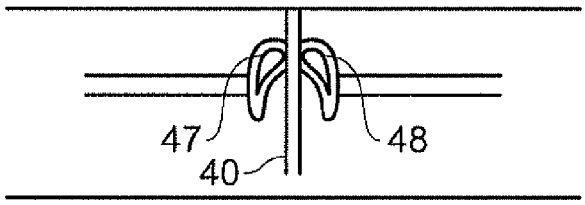
FIG. 4 shows the arrangement of FIG. 3 but with a component projecting through the side wall and sealing with the sealing members.

FIGS. 3 and 4 show schematic cross sectional views of a different arrangement. Side wall 44 of the treatment chamber once more has an aperture 45 formed in it. Fluidised bed powder 46 is provided internally in the treatment chamber. Opposed sealing members 47, 48 are provided at the aperture 45. In FIG. 3, the aperture 45 does not have a component projecting through it, the sealing members 47 and 48 sealing against each other. FIG. 4 shows the same arrangement as FIG. 3, but here blade 40 projects through the aperture 45 and sealing members 47, 48 seal against opposite sides of the blade 40.

Figure 5:
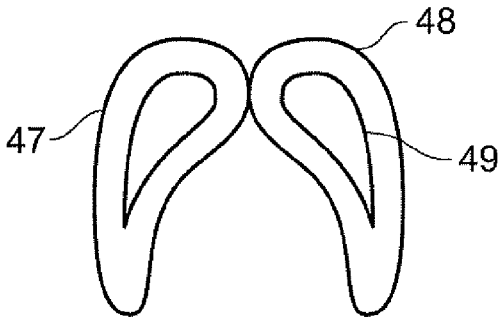
FIG. 5 shows an enlarged schematic sectional view of hollow sealing members suitable for use with the arrangements of FIGS. 3 and 4.

FIG. 5 shows a schematic cross sectional view of sealing members 47 and 48. Each sealing member is hollow, defining an internal cavity 49. The internal cavity allows each sealing member to deform to accommodate the blade 40 and to conform with the shape of the blade 40. Additionally, the cavity allows for the flow of coolant internally along each sealing member. This is of interest in order to prevent overheating of the material of the sealing member.

In use, the treatment part of the component is inserted into the treatment chamber, through at least one of the apertures 26-34, before fluidisation of the particulate. Therefore the treatment part of the component is located above the upper surface of the non-fluidised bed of powder. The seal is located between the component and the aperture. Any non-used apertures are blanked off using suitable blanking means (not shown). The bed is then fluidised, and the fluidised surface of the bed rises to cover the entire treatment part of the component located in the treatment chamber. The boundary between the treatment part and the non-treatment part of the component is defined by the boundary containment surface, i.e. the seal between the component and the aperture.

As explained above, when a fluidised bed is fully operational, the top surface of the fluidised media is typically uneven due to a phenomenon similar to bubbling. As such, if a component is to be partially submersed into the bed, it is very difficult to control and maintain the amount of surface coverage of bed media to component. However, in the preferred embodiment described here, introducing the component at the side of the bed ensures controlled media coverage of the treatment part of the component and a well-defined boundary between the treatment part and the non-treatment part. Thus, the need for creating a level top surface of fluidised media is eliminated. Also, a more uniform temperature gradient across the component in question can be achieved. The design also allows for the component to be adjusted in height relative to the bed if required.

As will be noted, FIG. 1 does not show how the used fluidising gas is removed from the treatment chamber. This issue is discussed in more detail with respect to FIG. 6.

Figure 6:
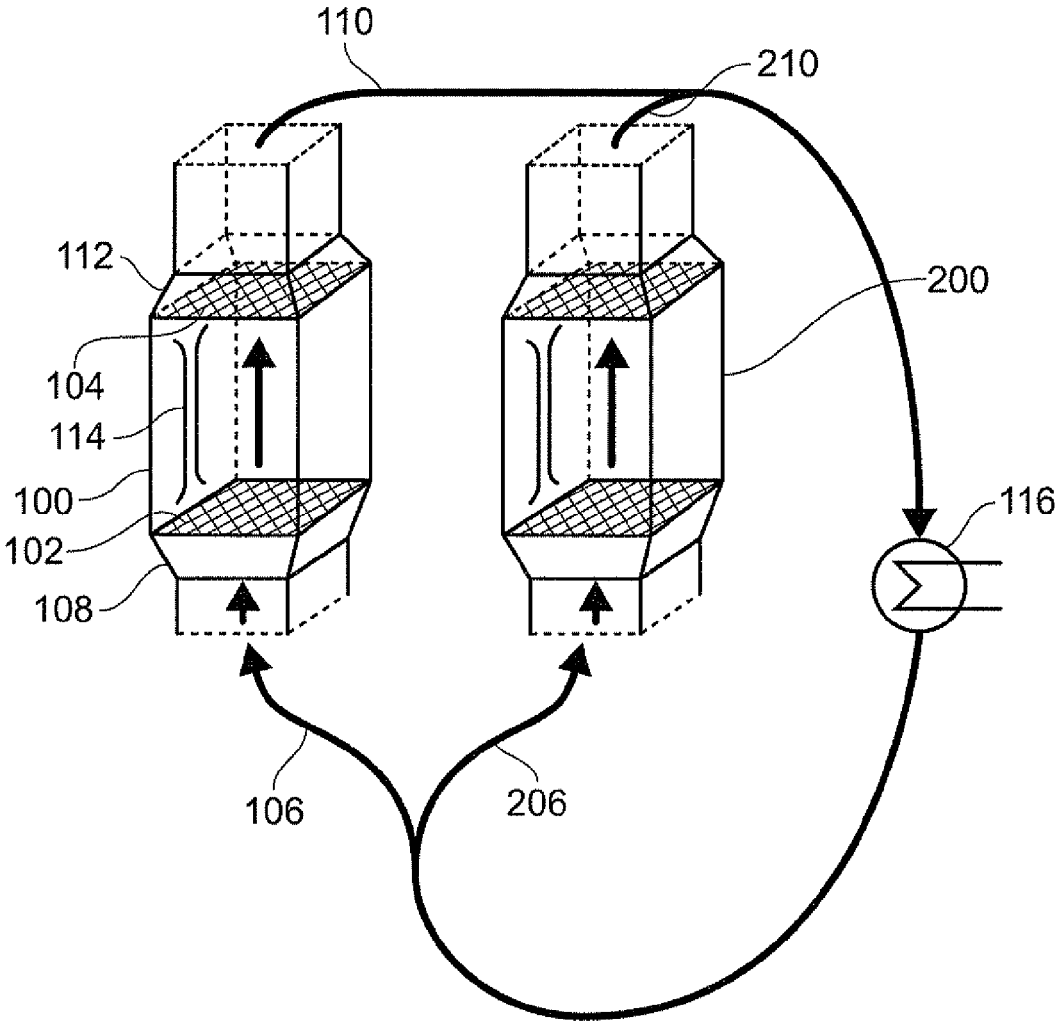
FIG. 6 shows schematic view of an apparatus according to a preferred embodiment of the invention.

FIG. 6 shows an apparatus according to a preferred embodiment of the invention. Treatment chamber 100 is bounded below by distribution plate 102 and powder screen 104. Fluidising gas inlet conduit 106 is in fluid communication with fluidising gas inlet 108 in order to provide a supply of pressurised fluidising gas to distribution plate 102 in order to ensure fluidisation of a bed of powder (not shown) to form a fluidised bed (not shown).

Fluidising gas outlet conduit 110 is in fluid communication with fluidising gas outlet 112 in order to provide a route for removal of the used fluidising gas from the treatment chamber. In order to reach the fluidising gas outlet 112, the fluidising gas must first pass through powder screen 104, which filters substantially all entrained powder from the gas passing through powder screen 104.

In practice, the distribution plate 102 and the powder screen 104 may have similar shape and may be formed of similar sized mesh. The mesh size is selected in accordance with the particle size and particle size distribution of the powder. In some embodiments, the mesh size of the powder screen 104 may be larger than the mesh size of the distribution plate 102. In some embodiments, the area of the powder screen 104 may be larger than the area of the distribution plate 102, thereby assisting in avoiding build up of powder at the powder screen.

In order to treat a treatment part of a component, the treatment part is inserted into the treatment chamber 100 through aperture 114 in the side wall of the treatment chamber, in the manner already described with respect to FIG. 1. Subsequently, the bed of powder (not shown) is fluidised by a suitable gas flow through the distributor plate 102 and the upper surface of the fluidised bed rises to cover the entire treatment part of the component. The upper surface of the fluidised bed can be allowed to rise (e.g. on further increase of the fluidising gas flow rate) until the upper surface of the fluidised bed meets the powder screen. In this manner, the powder screen can be used to ensure that the entire treatment chamber is filled with the fluidised bed, but that the powder is not forced out of the treatment chamber into the fluidised gas outlet 112.

In FIG. 6, the fluidising gas is stored and pressurised in a combined fluidising gas reservoir and pump 116. Suitable systems will be known to the skilled person.

In FIG. 6, a second treatment chamber 200 is shown. In this embodiment, this second treatment chamber has a similar structure to the first treatment chamber 100 and is intended for treating either another treatment part of the same component, or a treatment part of a different component. However, it is possible that the second chamber be used to treat a component of an entirely different geometry.

The second treatment chamber has a corresponding fluidising gas inlet conduit 206 and fluidising gas outlet conduit 210. To allow separate control of the gas flow in the second treatment chamber, it is preferred for these conduits to be connected separately to the combined fluidising gas reservoir and pump 116 as compared with the conduits for the first treatment chamber 100. However, as shown in FIG. 6, it is convenient for these conduits to be grouped together. Alternatively, these respective conduits may be connected at Y-junctions, and suitable pressure regulation provided as required along the respective conduits.

The conduits may be provided by shaped or flexible hosing of the type known to the skilled person for use in the pressure ranges of interest. The use of flexible conduits allows the treatment chamber(s) to be moved independently of the combined fluidising gas reservoir and pump 116 (which may be rather bulky) and thus allow the treatment chamber(s) to be presented to and enclose the treatment part of the component to be treated. This is particularly useful for treating components that are difficult to access or difficult to remove from their installation locations. Such components can be locally and selectively treated. The remote treatment chamber creates a small custom/modular boundary between the treatment part of the component (e.g. blade) and the non-treatment part of the component. This allows for specific targeting of various regions of a component that would not be possible by immersion of the component into the surface of a known fluidised bed. Specific temperature distributions can be induced in a component, allowing for a predetermined localised heat treatment. Additionally, other areas of the component can be actively cooled to enhance the temperature distribution across the area of component being treated.

In the preferred embodiment, the treatment applied to the component is a local heat treatment. The fluidising gas may be heated. This is preferably done at the combined fluidising gas reservoir and pump 116. Additionally or alternatively, the treatment chamber 100 may be heated. This can be done using a heater jacket (not shown) around the treatment chamber. The heat is transferred to the treatment part of the component via the fluidised bed of powder, which also acts as a heat sink, whereby the thermal mass of the powder reduces temperature fluctuations across the treatment part.

Temperature control of the treatment part of the component can be achieved in a direct manner, e.g. using one or more thermocouples in the bed. Alternatively, temperature control can be indirect, through measurement of flows, power input and exit gas temperatures or a combination of the aforementioned.

The particulate may have a multi-modal size, shape or density distribution, in order to provide a desired treatment efficacy.

Air may be used as the fluidising gas. Alternatively (and preferably), other gases may be used.

As will be understood by the skilled person, it is not essential to ensure that the flow of powder in the fluidised bed is constant in all locations. Indeed, differential flow in different regions of the bed may provide advantageous effects. Thus, one or more different regions of the bed may be blanked off or made stagnant. This can be achieved using specific insulation or purposeful localised particle stagnation. Further means for achieving differential treatment can be provided by providing localised differential fluidising gas flow, e.g. by appropriate control of the gas flow in the plenum chamber. A diversionary gas stream bifurcation may be used to regulate pressure.

A high level of coverage of the component by the fluidised powder can be achieved by use of multiple inlets (not shown) within the treatment chamber. These inlets can be arranged in order to avoid uneven exposure of the component. The specific arrangement can be designed based on the shape of the treatment part of the component, typically in order to ensure that streams of fluidised media come into contact with the component in regions where fluidised media circulation is expected to be at a minimum, in view of the intrusion of the component into the treatment chamber.

The shape of the treatment chambers shown in FIGS. 1 and 6 are based on a rectangular shape. However, depending on the component to be treated, it is possible for the treatment chamber to be of any suitable shape. One particularly useful shape for treating turbomachinery components is an annular shape, in which the treatment parts of the component are inserted into the treatment chamber through either an inner annular side wall or an outer annular side wall of the treatment chamber.

The term "heat treatment" used herein includes heating and cooling. Cooling can be carried out by appropriate refrigeration of the fluidising gas and/or alumina powder. Fluidised beds have many other uses in industry, including carrying out chemical reactions. The preferred embodiments of the invention allow any suitable fluidised bed process to be adapted by allowing a component to be treated by introduction at the side of the fluidised bed. This allows local, more uniform media flow around the treatment part of the component. Further applications in industry include:

Drying
Pre-heating
Surface engineering
Cooling
Combustion
Nitriding
Flame free heater for repair in a hazardous environment
Sterilisation
Shrink fitting While the invention has been described in conjunction with the exemplary embodiments described above, many equivalent modifications and variations will be apparent to those skilled in the art when given this disclosure. Accordingly, the exemplary embodiments of the invention set forth above are considered to be illustrative and not limiting. Various changes to the described embodiments may be made without departing from the spirit and scope of the invention.

All references referred to above are hereby incorporated by reference.

The invention claimed is:

1. A process for treating a treatment part of a component, the component having the treatment part and a non-treatment part, the process comprising:

providing a treatment chamber having a bed of powder;

flowing a fluidising gas into the treatment chamber from a fluidising gas inlet to fluidise the bed of powder;

preventing loss of powder from the fluidised bed of powder entrained in the fluidising gas by providing a powder screen between the treatment chamber and a fluidising gas outlet from which the fluidising gas is removed from the treatment chamber; and moving the treatment chamber with respect to a source of pressurized fluidizing gas;

moving the treatment chamber to surround only the treatment part of the component;

contacting only the treatment part of the component with the fluidised bed of powder to treat the treatment part of the component;

wherein:

the fluidising gas inlet is supplied with the fluidising gas via a fluidising gas inlet conduit, and the fluidising gas inlet conduit is connected to the source of pressurised fluidising gas.

2. The process according to claim 1, wherein:

the fluidising gas is recycled; and the fluidising gas outlet is in communication with a fluidising gas outlet conduit.

3. The process according to claim 2, wherein:

the fluidising gas outlet conduit is in communication with a fluidising gas reservoir; and the fluidising gas is subjected to a heat exchange process in the reservoir to recover thermal energy from the fluidising gas.

4. The process according to claim 1 wherein:

a distribution unit is located between the fluidising gas inlet and the treatment chamber; and the distribution unit is configured to distribute the incoming fluidising gas to generate the fluidised bed.

5. The process according to claim 4, wherein:

the distribution unit comprises a distribution plate; and a surface area of the powder screen is larger than a surface area of the distribution plate.

6. The process according to claim 1, wherein the treatment chamber comprises more than one fluidising gas inlet.

7. The process according to claim 1, further comprising:

providing one or more further treatment chambers;

flowing the fluidising gas into the treatment chamber and the one or more further treatment chambers to form more than one fluidised bed; and contacting more than one treatment parts of one or more components with the more than one fluidised bed.

8. The process according to claim 1, further comprising heating or cooling the fluidised bed via a heater or cooler in contact with the treatment chamber to thermally treat the treatment part of the component.

9. The process according to claim 1, further comprising heating or cooling the fluidising gas by a heater or cooler located remotely from the treatment chamber.

* * * * *